United States Patent [19]

Jacquet et al.

[11] Patent Number: 4,841,106

[45] Date of Patent: Jun. 20, 1989

[54] SYMMETRIC PERCUSSION SWITCHING DEVICE USING A DEAD POINT OVER-RUN DEVICE

[75] Inventors: Bruno Jacquet, Rueil Malmaison; Frédéric Noirot, Asnieres Sur Seine; Jean-Pierre Tellier, Jouy Le Moutier, all of France

[73] Assignee: La Telemecanique Electrique, France

[21] Appl. No.: 84,730

[22] Filed: Aug. 13, 1987

[30] Foreign Application Priority Data

Aug. 14, 1986 [FR] France ..... 86 11737

[51] Int. Cl.[4] ..... H01H 21/42

[52] U.S. Cl. ..... 200/462

[58] Field of Search ..... 200/62, 67 B, 67 PK, 200/67 E, 73

[56] References Cited

U.S. PATENT DOCUMENTS 1,768,943 7/1930 Taylor ..... 200/67 B 2,752,446 6/1956 Carlson ..... 200/67 B

FOREIGN PATENT DOCUMENTS 698064 11/1979 U.S.S.R. ..... 200/73

*Primary Examiner*—Renee S. Luebke

*Attorney, Agent, or Firm*—William A. Drucker

[57] ABSTRACT

A symmetric percussion switching device is provided using a bistable dead point over-run device including an actuator movable between at least two positions and a control member whose movement causes rocking of the actuator from one to other of the two positions, after passing through the dead point, said device further comprising two switches whose actuating members cooperate with the actuator, respectively in the fractions of the stroke thereof adjacent said positions, said switches then being actuated by percussion so that the drawbacks of the conventional switching devices of this kind are avoided in which the pressure of the mobile contact on the fixed contact is substantially zero in the vicinity of the dead point changeover.

7 Claims, 3 Drawing Sheets

SYMMETRIC PERCUSSION SWITCHING DEVICE USING A DEAD POINT OVER-RUN DEVICE

BACKGROUND OF THE INVENTION

The present invention relates to a symmetric percussion switching device using a dead point over-run device.

Generally it is known that dead point over-run devices are currently used in electromechanical apparatus such for example as switchers or control contacts.

Thus, changeover assemblies have already been proposed using dead point over-run devices and including, movable in a given plane:

a lever which has at one of its ends a mobile contact element and which is mounted for rotation at a distance from this end about an axis perpendicular to said plane, so as to be able to pass from a first to a second angular position defining an angular preferably acute sector, these two angular positions being defined by two stops which each consist of a fixed contact element which cooperates with the mobile contact element, and a spring, one end of which is fixed to the lever at a position spaced apart from said axis and whose other end, associated with controlling means, is movable in translation in a region of said plane external to said angular sector.

In such a structure, the dead point position is reached when the spring extends colinearly with the lever.

In the absence of friction forces this dead point position is theoretically unstable, so that the least angular deviation on one side (or on the other) between the spring and the lever will cause the lever to swing to this side (or to the other).

It has proved that, in such a device, the transverse component of the forces applied to the lever by the spring (torque) is cancelled out on passing through the dead point before being reversed and that it remains very low in the two zones adjacent this point and situated on each side thereof.

This is a particularly important disadvantage particularly in the case where the movements imposed on the spring by said control means are slow movements and may include stopping times in said zones.

In fact, in these zones, the contact pressure, mobile contact element/fixed contact element, will be practically zero. Consequently, the quality of the electric contact will be decidedly poor and the passage of the current will take place in random fashion because of the disturbances (for example vibrations) by which the device is effected. It is clear that such an operation may be prejudicial to the circuits controlled by such a device and, in most cases, is unacceptable.

The purpose of the invention is then particularly to overcome these drawbacks by dissociating the actuation function provided by the dead point over-run device from the switching function and using, for this switching function, switching devices actuated by percussion by the dead point over-run device.

SUMMARY OF THE INVENTION

It provides generally a device using a bistable dead point over-run device having an actuator movable between at least two positions, and a control member whose movement causes the actuator to rock from one position to the other after passing through a dead point position, and two switch devices whose actuating members are disposed on each side of the actuator so that each of these actuating members cooperates with said actuator in a fraction of the stroke thereof, adjacent the corresponding one of the two positions.

According to the invention, in this device said actuator consists of a lever mounted for rotation about a first fixed axis so as to be able to rock between two stops defining two angular portions, and including at least one part adapted for cooperating with said actuating members, this lever being subjected to the action of a spring, a first end of which is fixed to the lever at a position spaced apart from said fixed axis and a portion of which, situated at a distance from said end is movable under the action of said control member, the assembly including said lever and said spring forming said bistable device.

Advantageously, the members for actuating the switch devices are urged by resilient means so as to exert an antagonistic force but of a value less than that produced by the actuator during said cooperation.

In the case where it is desired to form a changeover assembly, the two switches will be of the normally closed type, it being understood that, depending on the position which it occupies, the actuator will maintain one of the switch devices open, whereas the other which will not be acted or will be in a closed position.

BRIEF DESCRIPTION OF THE DRAWINGS

Embodiments of the invention will be described hereafter by way of non limitative examples, with reference to the accompanying drawings in which.

DESCRIPTION OF THE PREFERRED EMBODIMENTS

Figure 1:
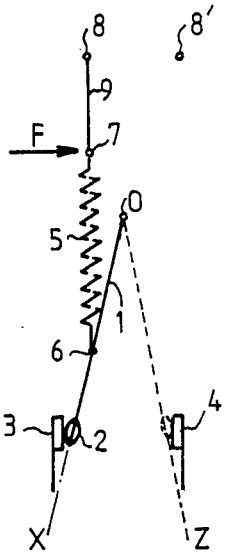
FIG.1 PRIOR ART
FIG. 1 is a schematical representation of a changeover switch of known type using a dead point over-run device.

With reference to FIG. 1, the double conventional changeover contact with dead point over-run device is formed of a mobile contact holder in the form of a lever 1 (or a blade) mounted at one of its ends for pivoting about an axis 0 and having at its other end a double contact insert 2.

This lever 1 may rock between two angular positions OX, OZ in which the double contact insert 2 comes into abutment at the end of travel against two respective fixed contact elements 3, 4.

Actuation of this lever 1 is provided by means of a spring 5 one end 6 of which is connected to lever 1 and the other end 7 of which is fixed to a support at a point 8 by means of a mechanical possibly flexible connection 9.

The movement of end 7 of the spring may therefore be caused either by a movement, for example a translational movement of the support point 8 or by exerting a force F on this end 7.

The relative arrangements of spring 5 and lever 1 is provided so that during the movement of its end 7, in one direction or in the other, spring 5 becomes colinear with the lever and so that in each of said directions passage through the dead point is obtained beyond which the lever, which was in one of the positions OX or OZ, will rock until it occupies the other position, thus bringing the double insert 2 into contact with the corresponding fixed contact element.

Figure 2:
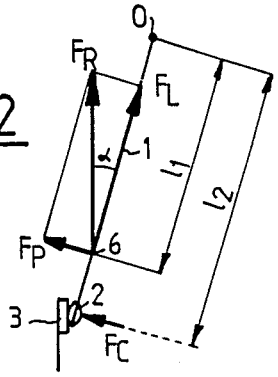
FIG.2 PRIOR ART
FIG. 2 is a diagram of the forces coming into play at the level of the rocker of the dead point over-run device shown in FIG. 1.

As can be seen in FIG. 2, the force $F_R$ exerted by spring 5 on lever 1 may be broken down into a force $F_L$ colinear with lever 1 and a force $F_P$ perpendicular to this latter, with $F_P$ equals $F_R \sin \alpha$, $\alpha$ being the angle formed by spring 5 and lever 1.

The contact force $F_C$ exerted at the level of the double contact insert 2 is then such that $F_C l_2 = F_P l_1$, $l_1$ being the distance from the end 6 of spring 5 to the axis of rotation 0 and $l_2$ being the distance between the double contact insert 2 and axis 0. The expression of this contact force $F_C$ is then the following:

$$F_C = F_P l_1 / l_2 = l_1 / l_2 F_R \sin\alpha$$

When, under the action of a force F applied to the end 7 or a movement bringing the support point 8 from the position shown to the position 8', spring 5 is aligned with lever 1, the angle $\alpha$ is zero and the contact force $F_C$ is zero.

This feature is not troublesome when the movement of end 7 of the spring is rapid. On the other hand, in the case where this movement depends on a physical magnitude of slow variation (thermostat, thermal relays) there may be a stoppage time in the vicinity of the dead point and, consequently, the maintenance in time of a situation in which the contact force is practically zero, which may be prejudicial to the correct operation of the associated automatic devices (poor contact because of a substantially zero force or through external vibrations).

The solution forming the subject of the present invention overcomes this drawback.

It uses a dead point over-run device of the above described type and therefore uses, in a similar arrangement, a lever or rocker 11 and a spring 12 one end 13 of which may be moved either by application of a force $F_B$ to this end or by movement of the support point 14.

However, in this case, the end 11' of lever 11 does not support a contact element but cooperates with members for actuating two switch devices disposed on each side of this end. Thus, passing through the dead point position by the end 13 of spring 12 will cause, following rocking of lever 11, percussion of one or other of the members actuating the switch devices.

Figure 3:
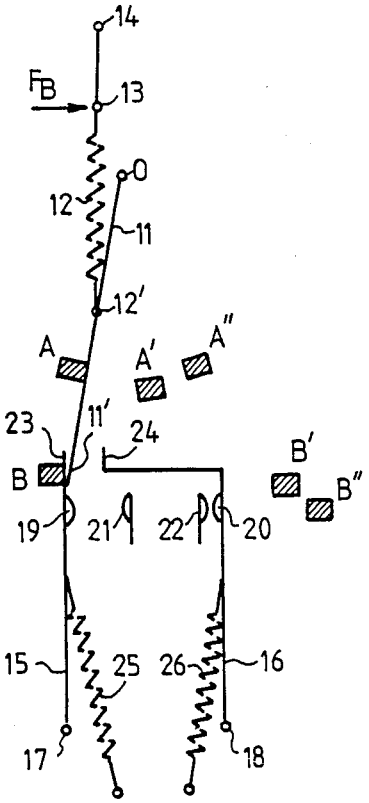
FIG. 3 shows schematically a double percussion switching device formed in accordance with the present invention.

In the example shown in FIG. 3, the switch devices each include a mobile contact holder 15, 16 consisting of a blade mounted for pivoting at one of its ends 17, 18 and the other end of which is provided with a mobile contact element 19, 20 which cooperates with a fixed contact element 21, 22. This end further includes a stop surface 23, 24 which extends in the path of the end 11' of lever 11 and thus serves as actuating member which the dead point passage device strikes for causing separation of the mobile contact element 19, 20 and the fixed contact element 21, 22.

Furthermore, each of the mobile contact holders 15, 16 is urged by a respective return spring 25, 26 tending to apply the mobile contact element 19, 20 against the fixed contact element 21, 22 which corresponds therewith. As will be seen further on, this spring 25, 26 whose action is antagonistic to that of spring 12 when end 11' of lever 11 cooperates with the stop surface 23, 24 of the mobile contact element 15, 16 which is associated therewith, serves for providing a slight anticipation of passage through the dead point.

In this example, rocking of lever 11 is limited by three stops, namely:

a first fixed stop A disposed on the mobile contact element 15 side, this stop A is intended to materialize a first stable condition corresponding to the rest position of the device; in this position, the mobile contact element 19 is held apart from the fixed contact element 21 by the action of the end 11' of lever 11 on the stop surface 23 of the mobile contact holder 15 (the torque exerted on lever 11 by the mobile contact holder 15 being less than that produced by spring 12); moreover, because the mobile contact holder 16 is not urged by lever 11, the mobile contact element 20 is in abutment against the fixed contact element 22 under the effect of spring 26.

a second stop A' disposed on the mobile contact holder 16 side and which materializes the second stable and reversible condition which corresponds to the tripped state of the device. This is the reverse position to that shown in FIG. 3, and in which the contact elements 20 and 22 are separated, whereas the contact elements 19 and 21 are in abutment, the mobile contact holder 16 then being urged by lever 11 whose end 11' comes to bear on the stop surface 24, the position of this stop A' is moreover provided so that a reversible and unstable condition can be obtained in which the lever 11 keeps its position as long as a sufficient force $F_B$ is exerted on the end 13 of spring 12; the use of this stop A corresponds in a thermal relay to the "automatic reset";

a third stop A" situated on the same side as stop A' but further away from stop A, so as to be in the zone where the device is no longer reversible, that is to say in which a reverse movement of the end 13 of spring 12 will not generate a new passage through the dead point and only external action can cause return to the rest position; the use of this stop A" corresponds in the thermal relay to the manual reset mode.

It should be noted that these stops can act not only on lever 11, as is the case of stops A, A', A", but also on the mobile contact holders 15, 16. This is why stops B, B', B" have been shown corresponding to this second case.

Taking into account the fact that the stops A' and A" are not used simultaneously, a device is provided for bringing one or other of these stops into service.

It so proves that the action of the mobile contact holders 15, 16 and of the corresponding springs 25, 26 on lever 11 slightly modifies the operating conditions of the dead point passage device previously described with respect to FIGS. 1 and 2.

Thus, if there were no spring 25, lever 11 would leave stop A as soon as spring 12 and the lever were aligned.

Because of the presence of spring 25 which acts in the rocking direction following passage through the dead point, a slight anticipation is obtained. During such rocking, the mobile contact holder 15 accompanies lever 11 for striking and pushing the mobile contact holder 16 until the mobile contact element 19 comes to bear on the fixed contact element 21. At that moment, the force produced on the stop surface 24 through the action of spring 12 is greater than that produced by spring 26, so that lever 11 continues its travel as far as stop A' or stop A".

Manual or automatic resetting can only take place to the extent that the end 13 of spring 12 has come back or is coming back to its original position (the one shown in FIG. 3). In the case of a thermal relay, such return may be provided by the withdrawal movement of the bimetal strips during the cooling phase.

Manual resetting may be provided by a movement of stop A" (or B") until it occupies the position of stop A' (or B').

If there were no spring 26, automatic resetting would occur as soon as spring 12 passed into the axis of lever 11.

The advantage of the above described device consists in that it eliminates the risk of having a zero contact pressure of the mobile and fixed contact elements not only during tripping but also during resetting. This provides greater reliability of the control of subordinate members and thus avoids known disturbances (microcuts, beating) met with in some conventional dead point over-run devices.

This device has shown itself to be particularly suitable to serve as the tripping/signalling element of a thermal relay.

In this case, the deformation of the bimetal strips of the relay gives a force $F_B$ applied to the end of the spring.

As mentioned above, the force $F_C$ delivered in the rest position perpendicularly to the end 11' of lever 11 has as expression:

$$F_C = l_1/l_2\, F_R \sin\alpha$$

This force being cancelled out when the angle $\alpha$ is zero, that is to say when spring 12 is in the axis of lever 11.

Figure 4:
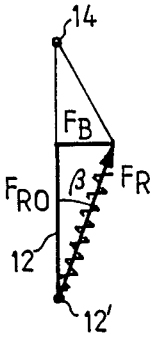
FIG. 4 is a diagram of the forces brought into play during application of a force $F_B$ on the spring associated with the rocker used in the device shown in FIG. 3.

Moreover, the force exerted by the bimetal strips on the end 13 of the spring, with the support point 14 remaining fixed, causes a movement leading to the configuration shown in FIG. 4, in which spring 12 forms an angle $\beta$ with respect to the straight line passing through the support point 14 and through its end 12'.

The force delivered by the bimetal strips is equal to $F_B = F_R \sin\beta$ and, because angles $\alpha$ and $\beta$ are assumed small, it may be reckoned that force $F_R$ is substantially equal to the initial force $F_{RO}$ (i.e. because of the negligible extension of spring 12, the force exerted axially by this spring is substantially constant and equal to the initial force $F_{RO}$), and that the force/stroke diagram of $F_B$ is linear.

Now, the force $F_C$ delivered at the end 11' of lever 11 depends solely on the force $F_R$ which is assumed constant and on angle $\alpha$ which is assumed small.

It may then be reckoned that the force/stroke diagram at the end 11' of lever 11 is linear during rocking.

Figure 5:
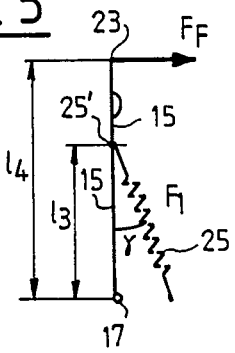
FIG. 5 is a diagram of the forces brought into play at the level of one of the mobile contact holders used in the device shown in FIG. 3.

In so far as force $F_F$ is concerned delivered at the level of the stop surface 23 by the mobile contact holder 15 and its spring 25, this force which is shown in FIG. 5 has for expression:

$$F_F = l_3/l_4 F_1 \sin\gamma$$

in which:

$l_3$ is the distance between the fixing point 25' of spring 25 on the mobile contact holder 15 and the axis of rotation 17, $l_4$ is the distance between the stop surface 23 and axis 17, $\gamma$ is the angle formed by spring 25 and the mobiile contact holder 15 (or more generally the straight line joining the stop surface 23 to axis 17), and $F_1$ is the axial force exerted by the spring 25.

Similarly, the force $F_0$ delivered at the level of the contact surface 24 by the mobile contact holder 16 and its spring 26 has for expression:

$$F_0 = l_5/l_6 F_2 \sin\delta$$

in which the expressions $l_5$, $l_6$, $F_2$ and $\delta$ are the homologues of the expressions $l_3$, $l_4$, $F_1$ and $\gamma$.

The angles $\gamma$ and $\delta$ being assumed small, it may be admitted that, for the two mobile contact holders 15, 16, the force/stroke diagrams are linear.

Taking into account the fact that the two mobile contact holders of the changeover assembly are actuated by deformations of the bimetal strips of the relay caused by heating or cooling, it is preferable for the force/stroke diagrams of these mobile contact holders to be symmetrical.

The force $F_F$ delivered at rest by the mobile contact holder 15 is antagonistic to that $F_C$ of lever 11. The action of the bimetal strips on the end 13, by deforming spring 12, will reduce the angle $\alpha$ and force $F_C$. So as to have clear cut operation, as soon as $F_C$ becomes slightly less than $F_F$ the lever 11 must be able to rock cleanly to its second stable condition. In passing it must then be able to deliver to the stop surface 24 a force greater than the resistant force supplied by spring 26 of the mobile contact holder 16 so as to cause opening of the contact elements 20, 22.

For safety's sake, this passage must take place cleanly exclusive of kinetic energy, that is to say statically, the drive force exerted by lever 11 and the mobile contact holder 15 must be greater than the resistant force exerted by the stop surface 24.

For this, the slope of the drive force $F_C$ must be much greater than those of the resistant forces exerted by the mobile contact holders.

Figure 6:
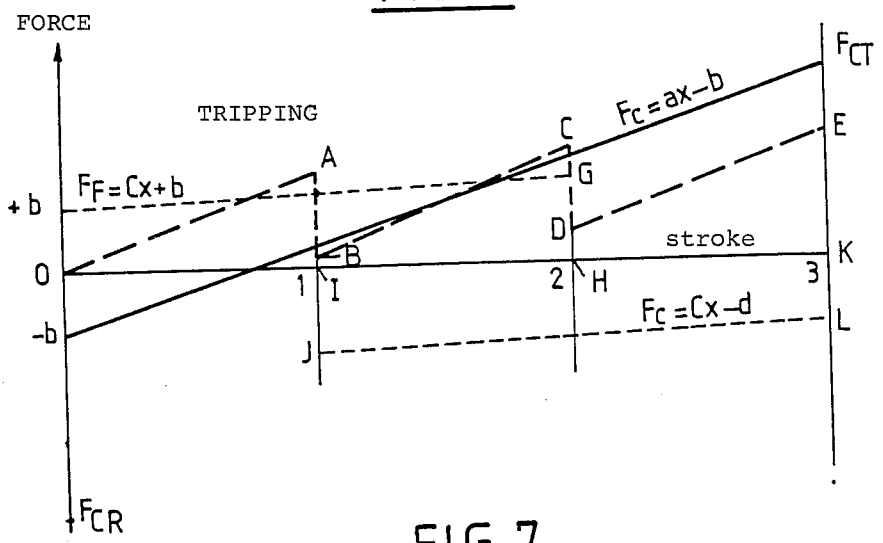
FIG. 6 is a diagram representative of the forces and of the strokes at the level of the stop surfaces of the two mobile contact holders of the device shown in FIG. 3, during the release phase.

This feature is illustrated by the diagrams of FIGS. 6 (tripping) and 7 (resetting) in each of which a stroke scale is plotted as abscissa and a force scale as ordinates. These two scales are in arbitary units. These diagrams are representative of the forces and strokes at the level of the stop surfaces 23 and 24. For reasons of symmetry, the total stroke has been divided into three substantially equal parts.

As can be seen in these Figures, in the rest position, the force $F_C$ at the end of the lever 11 is situated at a point $F_{CR}$ on the negative scale of the forces. The stop surface 23 of the mobile contact holder 15 bears on the end of lever 11 with a force equal to $F_F$ of the form $F_F = cx + b$. At rest, corresponding to abscissa 0, we have $F_{F=b}$.

The abscissa point 1 corresponds to driving of the stop surface 24 of the mobile contact holder 16 by the end 11' of lever 11.

The abscissa point 2 corresponds to closure of the switch device including the contacts 19 and 21.

The abscissa point 3 corresponds to the tripped condition.

In normal operation of the thermal relay, lever 11 is in the rest position and spring 12 generates at its end a force $F_{CR}$ which has been situated at an arbitary value on the negative ordinates less than the ordinate $F_C$ for abscissa 0 after resetting. In the case of an overload causing heating of the bimetal strips, this force decreases or rather becomes less negative. When it reaches the value $-b$, it just counterbalances the rest force exerted by the contact holder 16. As soon as it arrives close to the value $-b$, $(-b+\epsilon)$, lever 11 changes state and the force generated at its end is, between abscissa points 0 and 3, of the form $F_C=ax-b$. The saw tooth curve OABCDE represents the resultant (algebraic sum) of the forces in play at the level of stop surfaces 23, 24.

The mobile contact holder 16 which has a characteristic symmetric with that of the mobile contact holder 15, so of the same slope C, is shown by a straight line of the form $F_O=Cx-d$.

Figure 7:
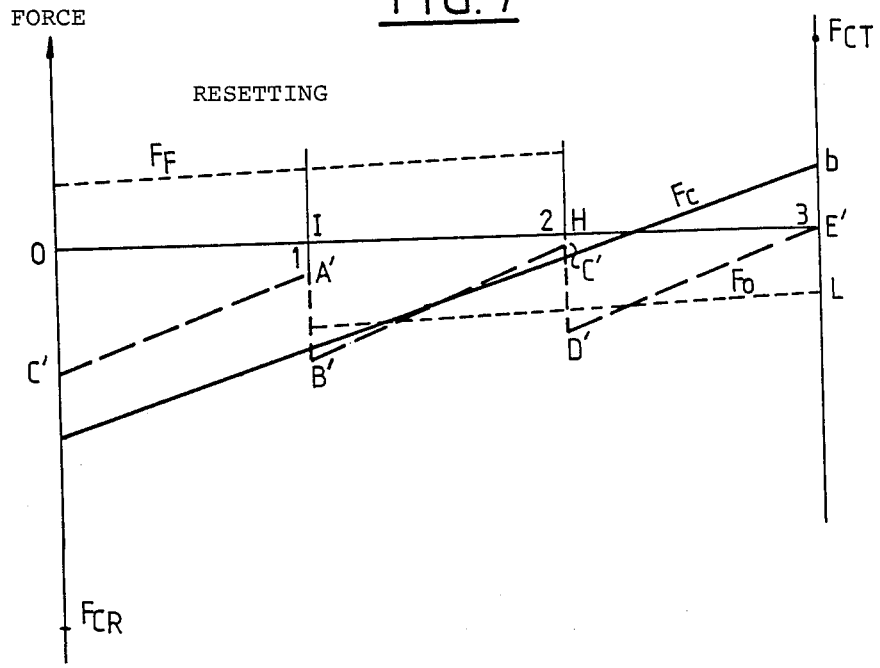
FIG. 7 is a diagram similar to that of FIG. 6, but in the case of the resetting phase.

Automatic resetting of the device is provided through a reverse procedure which is illustrated in FIG. 7.

During tripping, the force at end 11' of lever 11 had reached the value $F_{CT}$. After tripping, the bimetal strips of the relay cool down, which results in a reduction of the force applied to end 13 of spring 12 and, consequently, by a decrease of force $F_{CT}$. When this force reaches the value b, it balances out the force generated at the level of stop surface 24 by spring 26. For a value of $F_C$ slightly less than b, the lever rocks and returns to the position shown in FIG. 3. This operation is symmetrical with the preceding one, this symmetry being accordingly found in the diagram of FIG. 7.

The operating conditions of the above described device are then the following, it being understood that for safety's sake, account has not been taken of the kinetic energy of the moving parts.

Condition 1: At abscissa point 0 the force $F_F$ must be positive whence $b>0$.

Condition 2: At abscissa point 1, lever 11 must be driving, which means that force $F_C$ which is of the form $F_C=ax-b$ must be positive, namely $F_C=a-b>0$ or $a>b$.

Condition 3: At the abscissa point 1, the lower part of the saw tooth resultant must be greater than or equal to zero, namely $\overline{F_F}+\overline{F_C}+F_O\geqq 0$, which is represented by the equation $cx+b+ax-b+cx-d=BI\geqq 0$, and for $x=1$, by the condition $a+2c-d=BI\geqq 0$.

Condition 4: At abscissa point 2, the lower part of the saw tooth resultant must be greater than or equal to zero, namely $\overline{F_C}+\overline{F_O}\geqq 0$, which is represented by the equation $ax-b+cx-d=DH\geqq 0$, and for $x=2$ by the condition $2a-b+2c-d=DH\geqq 0$.

Condition 5: Starting with the assumption that the mobile contact holders 15, 16 have the same characteristics, that is to say that in similar situations the forces are the same, and, in particular, that:

$$\overline{HG}=\overline{IJ} \text{ or } \overline{HG}=-\overline{IJ} \text{ or } F_F(2)=-F_O(1)$$

We then obtain the following relationships:

$$2c+b=-c+d \text{ namely } 3c+b-d=0$$

By including this result in the two preceding equations, we obtain:

$$\left.\begin{aligned} BI &= a-c-b=a-b-c\geqq 0 \\ DH &= 2(a-b)-c\geqq 0 \end{aligned}\right\} a-b-c\geqq 0$$

It should be noted that the equality $BI=DH$, for $a=b$ must be dismissed because it is contrary to the condition $1a>b$.

Condition 6: From the relationship $a-b-c\geqq 0$, we derive the slope c of the characteristics of the mobile contact holders 15 and 16: $c\leqq a-b$.

For good reliability in operation, it is desirable to have the greatest force at the contacts, namely the greatest force at the ends of the mobile contact holders 15 and 16 so as to ensure more particularly a good shock resistance.

The force $F_F$ for abscissa 2 is equal to $F_F=cx+b=2c+b$.

b being positive, we will have maximum $F_F$ for maximum positive c, namely, in accordance with condition 6: $c=a-b$.

Therefore we have $F_F=2(a-b)+b=2a-b$.

Figure 8:
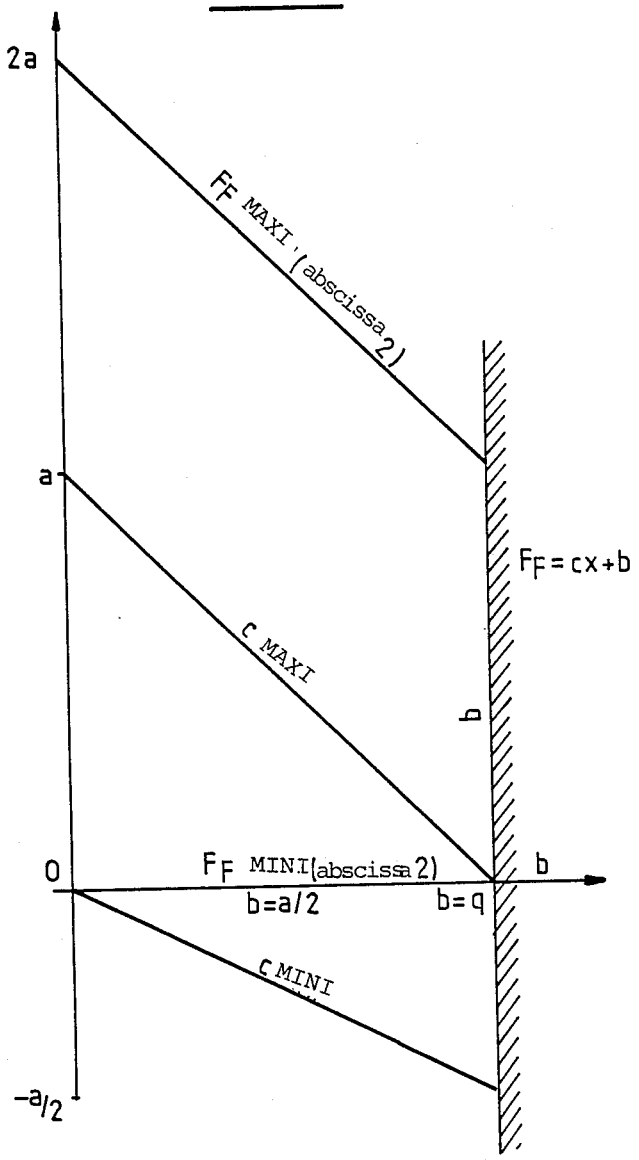
FIG. 8 is a diagram representative of the mutual variations of the parameters a, b, c and $F_F$ appearing in the diagram shown in FIGS. 6 and 7.

The mutual variations of the parameters a, b, c, $F_F$ are given in the diagram of FIG. 8;

From this Figure we may infer that lever 11 will drive cleanly if its slope a is appreciably greater than the slope c of the mobile contact holder F.

In practice, we may take a value c less than a/2.

The invention provides a solution for obtaining a mobile contact holder having a substantially zero slope c.

Figure 9:
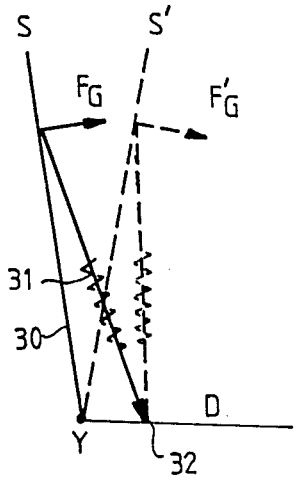
FIG. 9 is a schematical representation of one embodiment of a mobile contact holder urged by a spring and whose force exerted at the level of its stop surface has a substantially zero slope.

Such as shown in FIG. 9, this mobile contact holder is formed of a contact blade 30 mounted for pivoting at one of its ends by means of a pivot Y and movable between two angular positions YS and YS'. This blade 30 is urged by a spring 31 whose fixed attachment point 32 is situated on a straight line D passing through pivot Y and perpendicular to blade 30, when this latter occupies a middle position between the two positions YS, YS'.

In this case, considering the small angular variation of blade 30, the length of spring 31 remains substantially constant and the lever arm also. Similarly, the transverse forces $F_G$, $F'_G$ exerted at the end of blade 30 for the two angular positions YS, YS' are substantially equal.

The advantage of this type of mobile contact holder is that it avoids having to make any adjustment of force as a function of the stroke during manufacture.

What is claimed is:

1. A double percussion snap-acting switching device comprising:

(i) a bistable dead center over-run device including: a toggle arm mounted about a fixed axis for rocking between first and second positions and having a striker part; at least first and second stops respectively defining said first and second positions, a control means whose displacement causes rocking of the toggle arm from one to the other of said positions after passing through a dead center and a spring connected between said control means and said toggle arm;

(ii) first and second switches each comprising a fixed switch contact and a rigid switch arm carrying a movable switch contact and a surface portion on the switch arm disposed for engagement by said striker part after said toggle arm passes the dead center;

(iii) first and second further spring means respectively biasing the rigid switch arms of the respective switches towards the respective fixed switch contact with an antagonistic force lower than that produced by the toggle arm, said toggle arm exerting on each rigid switch arm a force which is a linear function of the displacement of said toggle arm having a first predetermined slope, whereas each rigid switch arm exerts on said toggle arm a resistance force which is a linear function of said displacement having a second predetermined slope, said first slope being substantially larger than said second slope.

2. The switching device of claim 1, wherein the first and second switches are normally closed.

3. The switching device of claim 1, wherein each of said rigid switch arms is mounted for pivoting about a pivot from a first to a second angular position and each of said further spring means has a fixed attachment point situated on a straight line passing through the pivot and perpendicular to the rigid switch arm when the rigid switch arm is in a third angular position which is at an equal angular distance from said first and second angular positions.

4. The switching device of claim 1, wherein said stops are positioned for engagement with the toggle arm.

5. The switching device of claim 1, wherein said stops are mounted for engagement with the rigid switch arms.

6. The switching device of claim 1, wherein at least said first rigid switch arm exerts on said toggle arm a resistant force which is a linear function of the displacement of said toggle arm having a zero slope.

7. The switching device of claim 6, wherein at least said first rigid switch arm is mounted for pivoting about a pivot from a first to a second angular position, said first spring means having a fixed attachment point situated on a straight line passing through said pivot and perpendicular to said first rigid switch arm when said first rigid switch arm occupies a third angular position which is at equal angular distance from said first and second angular positions.

* * * * *